US006792834B2

(12) United States Patent
Eriksson

(10) Patent No.: US 6,792,834 B2
(45) Date of Patent: Sep. 21, 2004

(54) TOOL FOR ROTATING CUTTING HEADS

(75) Inventor: Henrik Eriksson, Alunda (SE)

(73) Assignee: Sandvik AB, Sandviken (SE)

( * ) Notice: Subject to any disclaimer, the term of this patent is extended or adjusted under 35 U.S.C. 154(b) by 289 days.

(21) Appl. No.: 10/173,735

(22) Filed: Jun. 19, 2002

(65) Prior Publication Data

US 2003/0007842 A1 Jan. 9, 2003

(30) Foreign Application Priority Data

Jul. 3, 2001 (SE) ..... 0102368

(51) Int. Cl.[7] ..... B25B 13/48
(52) U.S. Cl. ..... 81/176.2; 81/176.3
(58) Field of Search ..... 81/176.1, 176.15, 81/176.2, 176.3

(56) References Cited

U.S. PATENT DOCUMENTS 790,853 A * 5/1905 Reddy ..... 81/176.2
1,384,705 A * 7/1921 Meyer ..... 81/176.3
4,718,317 A * 1/1988 Hensler ..... 81/176.3
4,819,523 A * 4/1989 Souza ..... 81/177.2
5,957,631 A 9/1999 Hecht
6,076,435 A * 6/2000 White et al. ..... 81/176.2

* cited by examiner

*Primary Examiner*—James G. Smith
(74) *Attorney, Agent, or Firm*—Burns, Doane, Swecker & Mathis, L.L.P.

(57) ABSTRACT

A tool for rotating a cutting head relative to a shaft includes a pair of identical L-shaped shanks. Each shank includes first and second parts oriented transversely to one another, with a shoulder projecting from the first part into a corner formed by the first and second parts. A free end of each first part includes a through-hole receiving the second part of the other shank, wherein the shoulders face one another in order to be able to grip a cutting head. Each second part is slidable in its respective through-hole to enable the distance between the shoulders to be adjusted to accommodate different-size cutting heads.

13 Claims, 4 Drawing Sheets

TOOL FOR ROTATING CUTTING HEADS

This application claims priority under 35 U.S.C. §§ 119 and/or 365 to Patent Application Serial No. 0102368-8 filed in Sweden on Jul. 3, 2001, the entire content of which is hereby incorporated by reference.

TECHNICAL FIELD OF THE INVENTION

The present invention relates to a tool for changing a replaceable cutting head of a tool for chip removing machining.

PRIOR ART

A device for assembling and disassembling a tool unit for chip removing machining is previously known from U.S. Pat. No. 5,957,631. This device has a cylindrical cavity with a diameter that equals the diameter of a replaceable cutting head included in the tool unit. In the cavity, convex portions are arranged that may be received in the chip channels of the replaceable cutting head. The device may also be provided with members that prevent the cutting head from falling out of the cavity when the same is fixed therein. The device is rotated by hand when the replaceable cutting head is to be assembled and disassembled. This device only fits a replaceable cutting head having a certain diameter and also in other respects, the cavity of the device and the replaceable cutting head are complementary.

AIMS AND FEATURES OF THE INVENTION

A primary aim of the present invention is to describe a tool of the kind defined in the introduction, which is exceptionally user-friendly due to the fact that the same may easily be adjusted to different diameter cutting heads with which the tool is to cooperate.

Another aim of the present invention is a tool should be structurally simple, and especially should consist of few components, and thereby also be inexpensive to manufacture.

Yet another aim of the present invention is that the design of a tool should be such that it is able to apply a relatively large torque to the replaceable cutting head.

The present invention relates to a tool for rotating a replaceable cutting head of a cutter device. The tool comprises two shanks connected to one another. Each shank includes first and second parts oriented transversely relative to one another. The first part of each shank includes a free end. A shoulder projects from the first part at a location which is intermediate the free end and a junction between the first and second parts. The shoulder is disposed within a corner defined by the first and second parts. The shanks are arranged with their respective shoulders generally facing one another. The first part of each shank has its free end mounted to the second part of the other shank.

Preferably the mounting permits sliding movement between the shanks to enable a distance between the shoulders to be adjusted in order to accommodate different-size cutting heads.

Preferably, each shank is of identical L-shaped configuration, and a stop element is detachably mounted to a free end of each of the second parts to prevent the shanks from becoming disconnected from one another.

BRIEF DESCRIPTION OF THE DRAWINGS

Below, embodiments of the invention will be described with reference being made to the accompanying drawings, where.

DETAILED DESCRIPTION OF PREFERRED EMBODIMENTS OF THE INVENTION

Figure 1:
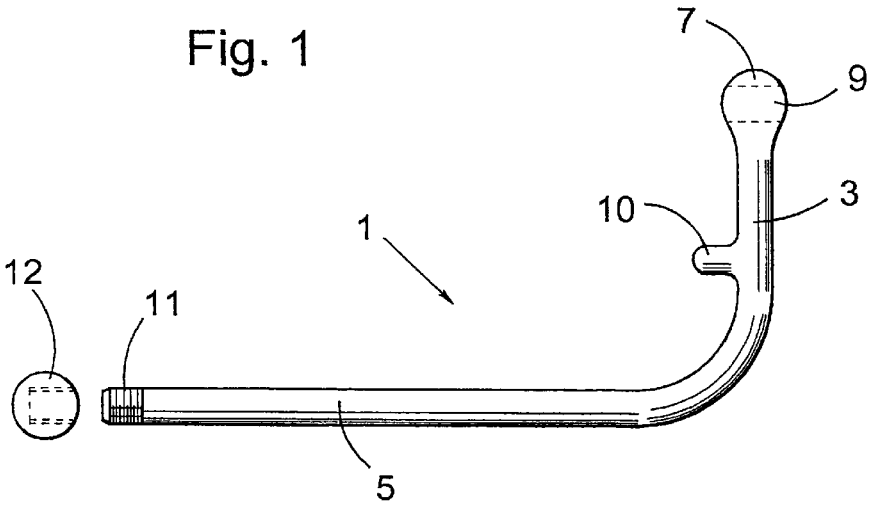
FIG. 1 shows a view of a shank included in the tool according to the present invention.
Figure 2:
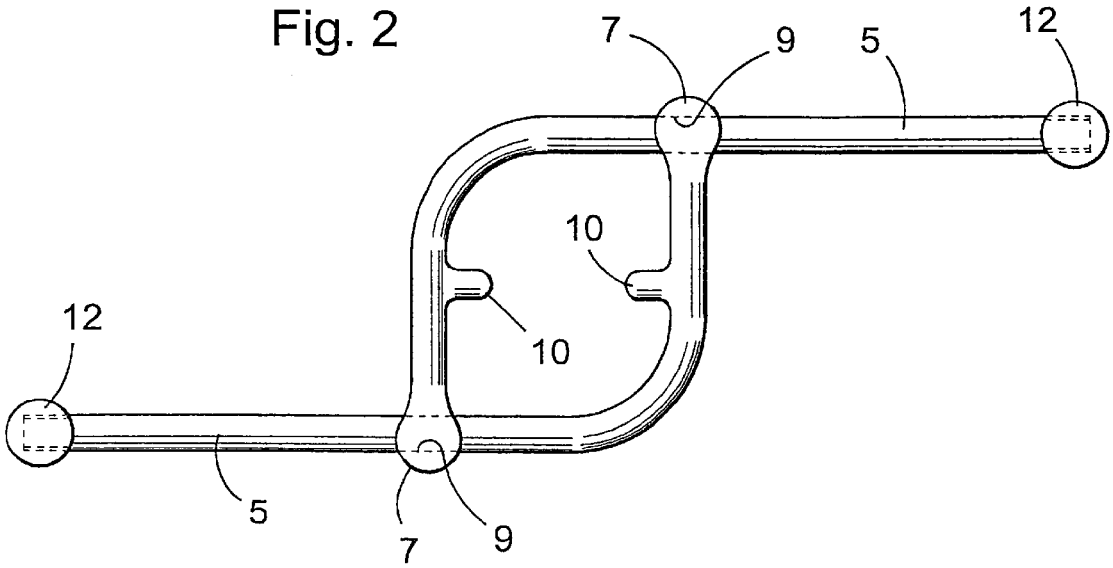
FIG. 2 shows a tool according to the present invention, which consists of two shanks according to FIG. 1.

A tool according to a first embodiment of the invention comprises two preferably identical shanks 1 (see FIG. 2). Each shank 1, illustrated in FIG. 1, is generally L-shaped and comprises a first part 3 and a second part 5, whereby the first the part 3 in the illustrated embodiment is shorter than the second part 5. The first part 3 is, at the free end thereof, provided with a thicker portion 7, which is penetrated by a hole 9 having an extension which is transverse to the extension of the first part and is, in the main, parallel to the extension of the second part 5. On an intermediate portion of the first part 3, i.e., at a location between the free end and the junction where the first part 3 joins the second part 5, a shoulder 10 is arranged that has an extension generally parallel to the free end of the second part 5. The shoulder 10 extends in a direction causing it to be located within the angle, or corner, defined between the first and second parts 3,5.

At the free end thereof, the second part 5 has an externally threaded part 11 that is intended to receive an internally threaded hole of a stop member in the form of a knob 12, which constitutes part of the tool according to the present invention.

The shanks 1 are mounted to each other by the fact that the second part 5 of each of the shanks 1 is received in the hole 9 of the other shank 1. In order to ensure that the second parts 5 remain in the respective holes, the knobs 12 are applied on the free ends of the second parts 5 by being threaded on the externally threaded portions 11.

From a study of FIG. 2, it will be understood that the shoulders 10 are directed towards each other and are spaced apart by a distance which may be varied by a displacement of each thicker portion 7 in relation to the appurtenant second part 5 of the other shank 1. The diameter of the holes 9 preferably relates to the diameter of the second parts 5 in such a way that a slide fit is formed between the second parts 5 and the holes 9. At a maximum distance between the shoulders 10, the thicker parts 7 will abut against the knobs 12.

Figure 3:
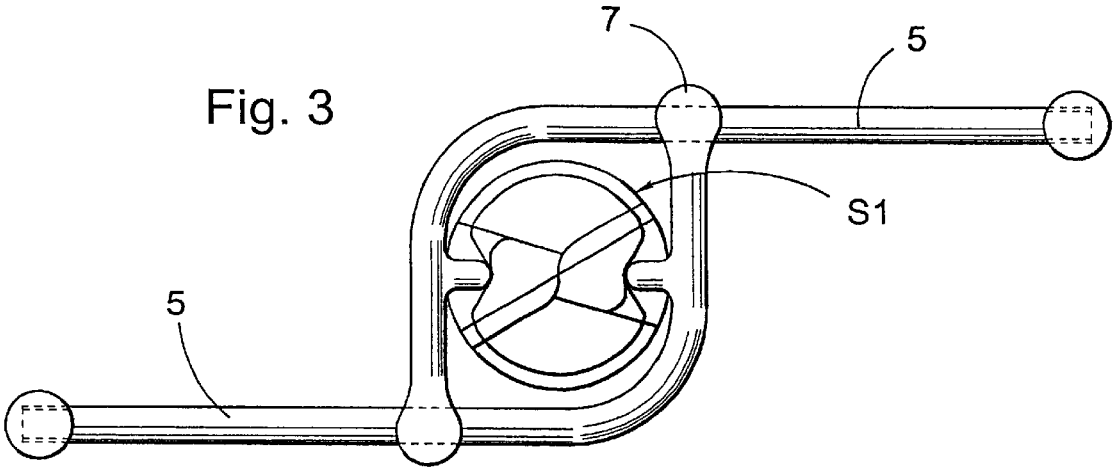
FIG. 3 shows an end view of a tool for chip removing machining, whereby the tool according to FIG. 2 is in engagement with a replaceable cutting head of the tool.

In FIG. 3, the manner of using the tool according to the present invention is shown with a drill having a relatively large diameter. In that connection, the shoulders 10 are brought to cooperate with, for instance, the chip channels of a replaceable cutting head S1. This takes place by the second parts 5 being displaced in relation to the holes 9. When the outer portions of the parts 5 apply a force in order to rotate the replaceable cutting head S1, a fixing of the second parts 5 in the holes 9 will take place due to the fact that friction is generated between the second parts 5 and the walls of the holes 9. Said friction is sufficient to inhibit relative motion between the second part 5 and the hole 9 of the thicker portion 7 during normal conditions. When the replaceable cutting head S1 has been assembled/disassembled, the tool is removed by further distancing the shoulders 10 from each other. This may easily be carried out since the friction between the second part 5 and the hole 9 is generated only when the parts 5 apply forces in order to rotate the replaceable cutting head.

Figure 4:
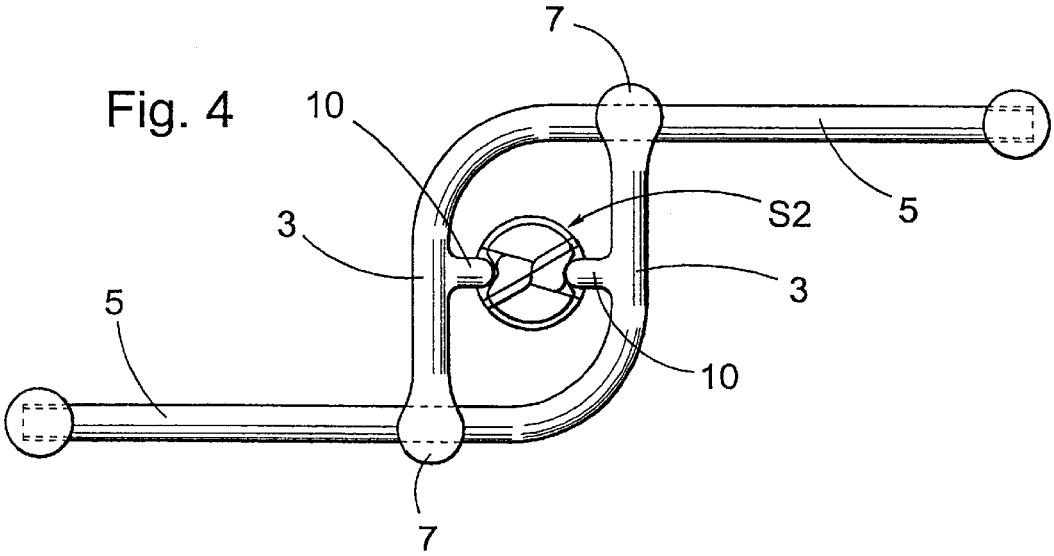
FIG. 4 shows an end view corresponding to FIG. 3, whereby the tool according to the present invention is in engagement with the replaceable cutting head of a tool for chip removing machining having a smaller diameter than the tool according to FIG. 3.

FIG. 4, the manner of using the tool according to the present invention is shown on drill having a substantially smaller diameter than the drill in FIG. 3. As is seen in FIG. 4, an adaptation to the diameter of the replaceable cutting head S2 of the drill is easily carried out by the shoulders 10 being pushed towards each other until they are brought into engagement with the replaceable cutting head S2 and more precisely until they are brought into engagement with a chip channel or some other groove. As for bringing about rotation of the replaceable cutting head, this is carried out in principally the same way as at the replaceable cutting head S1 according to FIG. 3. Disassembly of the tool according to the present invention in relation to the cutting head S2 is carried out by further distancing the shoulders 10 from each other.

Figure 5:
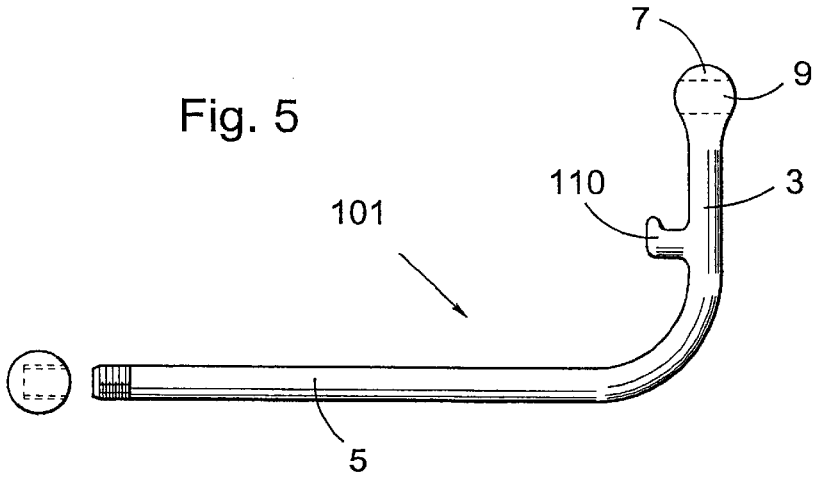
FIG. 5 shows an alternative embodiment of a shank for a tool according to the present invention.

The alternative design of a shank 101, illustrated in FIG. 5, differs from the shank 1 in the main by the design of the shoulder 110. For that reason, other parts of the shank 101 have been given the same reference numerals as for the shank 1. The shoulder 110 is L-shaped and comprises two parts 110*a*, 110*b* oriented perpendicularly to one another. The part 110*a* is longer than the part 110*b*, so the part 110*a* (the long part) has a longer bending radius than the part 110*b* (the short part).

Figure 6:
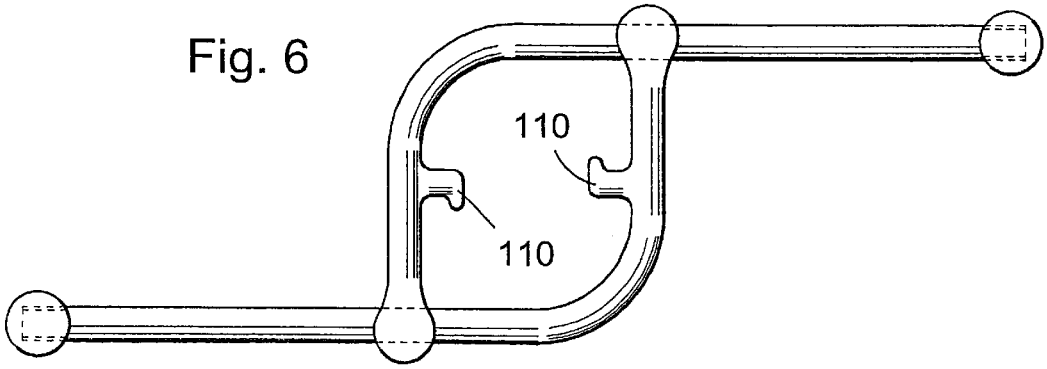
FIG. 6 shows a tool according to the present invention, which consists of two shanks according to FIG. 5.

How the two identical shanks 101 have been assembled in order to form a tool according to the present invention is shown in FIG. 6. In that connection, said assembly is carried out in principally the same way as in the tool illustrated in FIG. 2, i.e., each of the second parts 5 is received in a hole 9 of the first part 3 of the other shank.

Figure 7:
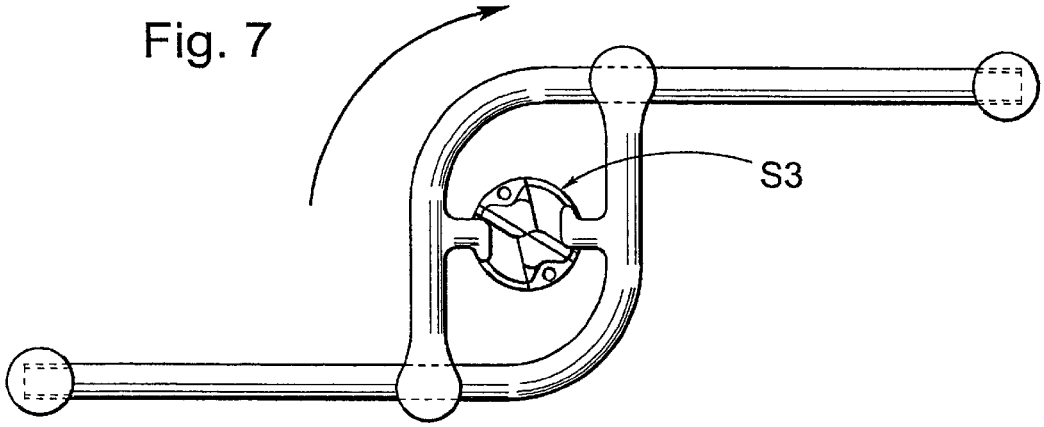
FIG. 7 shows an end view of a tool for chip removing machining, whereby the tool according to FIG. 6 is in a tightening engagement with a replaceable cutting head of the tool for chip removing machining.

How the tool according to FIG. 6 is used with a drill having a relatively small diameter when the replaceable cutting head S3 is to be assembled is shown in FIG. 7. In that connection, the long portions 110*a* of the shoulders 110 are brought to cooperate with, for instance, the chip channels of the replaceable cutting head S3.

Figure 8:
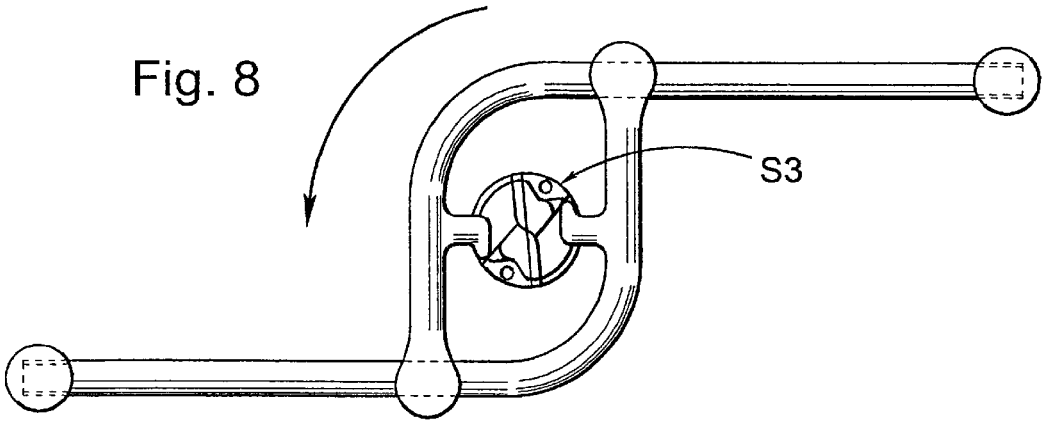
FIG. 8 shows an end view corresponding to FIG. 7, whereby the tool according to FIG. 6 is in a loosening engagement with a replaceable cutting head.

How the tool according to FIG. 6 is used when the replaceable cutting head S3 is to be disassembled is shown in FIG. 8. In that connection, the short portions 110*b* of the shoulders 110 are brought to cooperate with, for instance, especially designed grooves in the cutting head S3.

Feasible Modifications of the Invention

The two embodiments described above exemplify two designs of the shoulders 10, 110. Naturally, the design of the shoulders may be additionally varied within the scope of the invention, but it is important that a satisfactory cooperation between the shoulders and grooves of a replaceable cutting head is achieved both at tightening and loosening of the replaceable cutting head.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A tool for rotating a replaceable cutting head of a cutter device, the tool comprising:

two shanks connected to one another, each shank including:

first and second parts oriented transversely relative to one another, the first part of each shank including a free end, and a shoulder projecting from the first part at a location intermediate the free end and a junction between the first and second parts, the shoulder disposed within a corner defined by the first and second parts;

the shanks arranged with their respective shoulders generally facing one another, and wherein the first part of each shank has its free end mounted to the second part of the other shank.

2. The tool according to claim 1 wherein the free end of each first part includes a through-hole receiving the second part of the other shank.

3. The tool according to claim 2 wherein the free end of the each first part has an enlargement through which the hole is formed.

4. The tool according to claim 1 wherein each shank is substantially L-shaped.

5. The tool according to claim 1 wherein the shanks are of identical configuration.

6. The tool according to claim 1 wherein each shoulder includes a long portion projecting from the respective first part and a short portion extending transversely from an end of the long portion.

7. The tool according to claim 6 wherein the long portion extends parallel to the respective second part, and the short portion extends parallel to the respective first part.

8. A tool for rotating a replaceable cutting head of a cutter device, the tool comprising:

two shanks connected to one another, each shank including:

first and second parts oriented transversely relative to one another, the first part of each shank including a free end, and a shoulder projecting from the first part at a location intermediate the free end and a junction between the first and second parts, the shoulder disposed within a corner defined by the first and second parts;

the shanks arranged with their respective shoulders facing one another, and wherein the first part of each shank has its free end slidably mounted to the second part of the other shank to enable a distance between the shoulders to be adjusted.

9. The tool according to claim 8 wherein the free end of each first part includes a through-hole slidably receiving the second part of the other shank.

10. The tool according to claim 9 wherein a removable stop is mounted on a free end of each second portion to prevent the shanks from becoming disconnected from one another.

11. The tool according to claim 10 wherein each stop is connected to the respective second part by a screw threaded connection.

12. The tool according to claim 8 wherein the shanks are of substantially identical L-shape.

13. A tool for rotating a replaceable cutting head of a cutter device, the tool comprising:

two substantially identical L-shaped shanks connected to one another, each shank including:

first and second parts oriented transversely relative to one another, the first part of each shaft including an enlarged free end with a hole extending therethrough, and a shoulder projecting from the first part at a location intermediate the free end and a junction between the first and second parts, the shoulder disposed within a corner defined by the first and second parts;

the shanks arranged with their respective shoulders facing one another, and wherein the first part of each shank has its free end slidably mounted to the second part of the other shank; and a removable stop mounted on a free end of each second portion to prevent the shanks from being disconnected from one another.

* * * * *